US008754341B2

(12) United States Patent
Manahan et al.

(10) Patent No.: US 8,754,341 B2
(45) Date of Patent: Jun. 17, 2014

(54) ACTUATING MULTIPLE FEATURES OF A DEVICE LOCATED IN AN EXPLOSION-PROOF ENCLOSURE

(75) Inventors: Joseph Michael Manahan, Manlius, NY (US); Graig E. DeCarr, Cicero, NY (US)

(73) Assignee: Cooper Technologies Company, Houston, TX (US)

( * ) Notice: Subject to any disclaimer, the term of this patent is extended or adjusted under 35 U.S.C. 154(b) by 62 days.

(21) Appl. No.: 13/331,810

(22) Filed: Dec. 20, 2011

(65) Prior Publication Data

US 2012/0160052 A1 Jun. 28, 2012

Related U.S. Application Data

(60) Provisional application No. 61/426,429, filed on Dec. 22, 2010.

(51) Int. Cl.
*H01H 13/04* (2006.01)

(52) U.S. Cl.
USPC ..... 200/304; 200/332; 200/335

(58) Field of Classification Search
USPC ..... 200/304, 330, 332, 334, 341, 343, 200/318.1
See application file for complete search history.

(56) References Cited

U.S. PATENT DOCUMENTS

| | | | | |
|---|---|---|---|---|
| 2,828,352 | A | 3/1958 | Shewmon | |
| 3,371,181 | A * | 2/1968 | Van Mastrigt | 200/330 |
| 3,780,548 | A | 12/1973 | Anastasov | |
| 4,631,378 | A | 12/1986 | Nobesawa | |
| 4,737,609 | A | 4/1988 | Yuhasz et al. | |
| 4,767,901 | A * | 8/1988 | Goyarts | 200/306 |
| 5,140,293 | A | 8/1992 | Fournier et al. | |
| 5,577,603 | A * | 11/1996 | Bogdanovs et al. | 200/331 |
| 5,894,277 | A | 4/1999 | Keskin et al. | |
| 5,998,750 | A * | 12/1999 | Wegener et al. | 200/564 |
| 6,334,346 | B1 | 1/2002 | Wang | |
| 7,043,948 | B1 | 5/2006 | Wang | |
| 7,071,427 | B2 * | 7/2006 | Houck et al. | 200/50.05 |
| 7,316,139 | B2 | 1/2008 | Nakazima et al. | |
| 7,318,331 | B2 | 1/2008 | Miao | |
| 7,350,470 | B1 | 4/2008 | Stuhlbarg et al. | |
| 7,952,039 | B2 | 5/2011 | Manahan et al. | |
| 2006/0065027 | A1 | 3/2006 | Valentine | |
| 2006/0227113 | A1 | 10/2006 | Joyce et al. | |
| 2011/0132049 | A1 | 6/2011 | Meekma et al. | |

FOREIGN PATENT DOCUMENTS

| | | |
|---|---|---|
| JP | 8168118 A | 6/1996 |
| JP | 2002140952 | 5/2002 |
| JP | 2004040893 | 2/2004 |
| JP | 2006092965 | 4/2006 |

* cited by examiner

*Primary Examiner* — Kyung Lee
(74) *Attorney, Agent, or Firm* — King & Spalding LLP

(57) ABSTRACT

A system is described herein for actuating at least one feature of multiple features of a device located inside an enclosure. The system can include a depressor extending through an aperture in a surface of the enclosure. The depressor can include a depressor shaft having a first depressor end and a second depressor end, where the first depressor end is accessible from outside the enclosure. The depressor can move between an undepressed state and a depressed state. The second depressor end can contact the at least one feature of the multiple features of the device when the depressor is in the depressed state.

23 Claims, 11 Drawing Sheets

ACTUATING MULTIPLE FEATURES OF A DEVICE LOCATED IN AN EXPLOSION-PROOF ENCLOSURE

CROSS-REFERENCE TO RELATED APPLICATIONS

This application claims priority under 35 U.S.C. §119 to U.S. Provisional Patent Application Ser. No. 61/426,429, titled "Multi-Function Actuators For Use In Explosion-Proof Enclosures" and filed on Dec. 22, 2010, the entire contents of which are hereby incorporated herein by reference.

TECHNICAL FIELD

The present disclosure relates generally to actuating multiple features of a device, and more particularly to systems, methods, and devices for actuating one or more features of a device located within an explosion-proof enclosure using a keypad located outside the explosion-proof enclosure.

BACKGROUND

Explosion-proof receptacle housings and enclosure systems are used in many different industrial applications. Such explosion-proof receptacle housing and enclosure systems may be used, for example, in military applications, onboard ships, assembly plants, power plants, oil refineries, petrochemical plants, and other harsh environments. At times, the equipment located inside such explosion-proof receptacle housing and enclosure systems are used to control motors and other industrial equipment.

Traditional motor starters and related equipment fail to provide adequate torque control and result in excessive wear on the motor and associated equipment. Instead, variable frequency drives (VFDs) are often used in place of traditional motor starters. However, VFDs tend to generate heat and are subject to failure when exposed to excessive temperatures caused by the heat loss. A common practice to reduce heat-related problems is to remove the VFD to a remote location so that a explosion-proof receptacle housing and enclosure system is not required, allowing proper cooling of the VFD during operation. However, installation costs may increase and operational problems may result from increased line losses from the added distance that signals between the VFD and the related equipment must travel.

SUMMARY

In general, in one aspect, the disclosure relates to a system for actuating at least one feature of multiple features of a device located inside an enclosure. The system can include a depressor extending through an aperture in a surface of the enclosure. The depressor can include a depressor shaft having a first depressor end and a second depressor end, where the first depressor end is accessible from outside the enclosure. The depressor can move between an undepressed state and a depressed state. The second depressor end can contact the at least one feature of the multiple features of the device when the depressor is in the depressed state.

In another aspect, the disclosure can generally relate to a system for actuating multiple features of a device located inside an enclosure. The system can include a surface of the enclosure, where the surface includes a first aperture having first dimensions. The system can also include a plate slideably coupled to an underside of the surface, where the plate has second dimensions larger than the first dimensions of the first aperture, where the plate further includes a second aperture, and where the plate can move among a number of positions that correspond to the multiple features. The system can also include a depressor traversing through the second aperture. The depressor may include a bearing fixedly coupled to the second aperture of the plate. The depressor may also include a pushbutton located outside the enclosure and positioned inside the bearing, where the pushbutton moves between an undepressed state and a depressed state. The depressor may further include a depressor shaft that includes a first depressor end and a second depressor end, where the pushbutton is coupled to the first depressor end, and where the second depressor end is used to actuate the at least one feature of the multiple features of the device when the pushbutton is in the depressed state.

In yet another aspect, the disclosure can generally relate to a method for actuating at least one feature of multiple features of a device located inside an enclosure. The method can include receiving, from a user operating a keypad comprising a first end of a depressor, an instruction to move the first end of the depressor from an undepressed state to a depressed state, where the keypad is accessible from outside the enclosure. The method can further include contacting, while the first end of the depressor is in the depressed state, the second end of the depressor to the at least one feature of the device located inside the enclosure. The depressor can traverse an aperture in a surface of the enclosure.

These and other aspects, objects, features, and embodiments of the present invention will be apparent from the following description and the appended claims.

BRIEF DESCRIPTION OF THE DRAWINGS

The drawings illustrate only exemplary embodiments of actuating multiple features of a device within an explosion-proof enclosure and are therefore not to be considered limiting of its scope, as the invention may admit to other equally effective embodiments. The elements and features shown in the drawings are not necessarily to scale, emphasis instead being placed upon clearly illustrating the principles of the exemplary embodiments. Additionally, certain dimensions or positionings may be exaggerated to help visually convey such principles. In the drawings, reference numerals designate like or corresponding, but not necessarily identical, elements.

DETAILED DESCRIPTION

Figure 1:
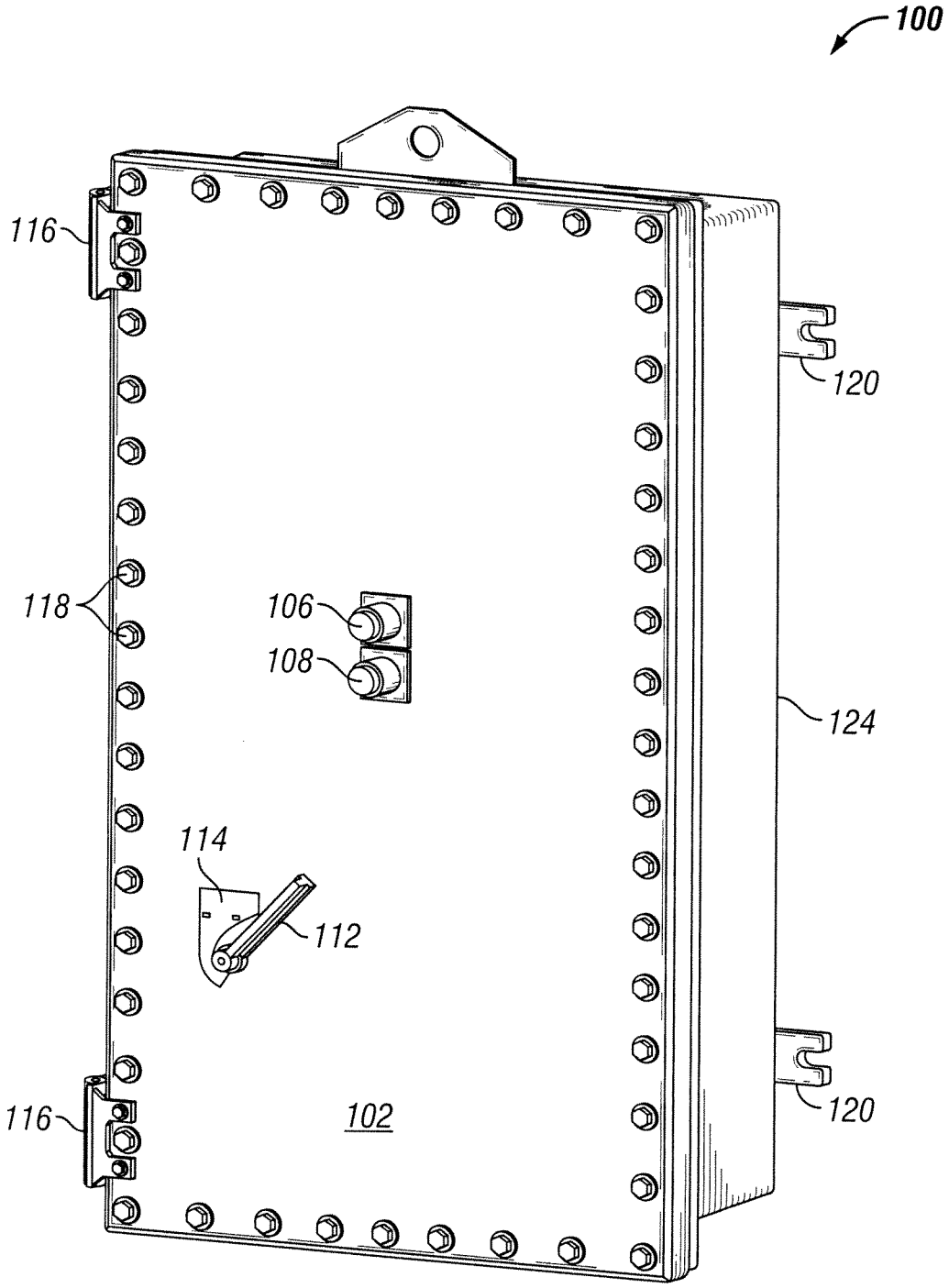
FIGS. 1 and 2 show explosion-proof enclosures in which one or more exemplary embodiments of actuating multiple features of a device may be implemented.

Exemplary embodiments of actuating multiple features of a device within an explosion-proof enclosure will now be described in detail with reference to the accompanying figures. Like elements in the various figures are denoted by like reference numerals for consistency.

In the following detailed description of exemplary embodiments of actuating multiple features of a device within an explosion-proof enclosure, numerous specific details are set forth in order to provide a more thorough understanding of actuating multiple features of a device within an explosion-proof enclosure. However, it will be apparent to one of ordinary skill in the art that actuating multiple features of a device within an explosion-proof enclosure may be practiced without these specific details. In other instances, well-known features have not been described in detail to avoid unnecessarily complicating the description. Further, certain descriptions (e.g., top, bottom, side, end, interior, inside) are merely intended to help clarify aspects of actuating multiple features of a device within an explosion-proof enclosure and are not meant to limit embodiments of actuating multiple features of a device within an explosion-proof enclosure.

In general, exemplary embodiments of actuating multiple features of a device within an explosion-proof enclosure provide systems, methods, and devices for actuating one or more features of a device located within an explosion-proof enclosure using a keypad located outside the explosion-proof enclosure. Specifically, exemplary embodiments of actuating multiple features of a device located within an explosion-proof enclosure provide for depressing one or more depressors on a keypad located outside the explosion-proof enclosure. In one or more exemplary embodiments, the device located within the explosion-proof enclosure includes a display and one or more features (i.e., device features) that are configured to be actuated (e.g., pressing a button, flipping a switch).

In one or more exemplary embodiments, a depressor is a collection of one or more components that, when used collectively, allow a user to actuate a device feature of a device located inside an explosion-proof enclosure. Components of a depressor may include, but are not limited to, a pushbutton, a bearing, a dial, a shaft, a stem, a sealing element, a compressible element, a housing, and a template.

While the exemplary embodiments discussed herein are with reference to explosion-proof enclosures, other types of non-explosion-proof enclosures (e.g., junction boxes, control panels, lighting panels, motor control centers, switchgear cabinets, relay cabinets) or any other type of enclosure may be used in conjunction with exemplary embodiments of actuating multiple features of a device. For example, exemplary embodiments may be used with hose-tight enclosures (e.g., an enclosure meeting National Electrical Manufactures Association (NEMA) 4 standards). In such a case, the enclosure is constructed to provide a degree of protection against, at least, falling dirt, rain, sleet, snow, windblown dust, splashing water, and hose-directed water.

A user may be any person that interacts with the explosion-proof enclosure or equipment controlled by one or more components of the explosion-proof enclosure. Specifically, a user may depress one or more depressors on a keypad coupled to the outside of the explosion-proof enclosure to activate one or more device features (also sometimes simply called a "feature") of the device located inside the explosion-proof enclosure. Examples of a user may include, but are not limited to, an engineer, an electrician, an instrumentation and controls technician, a mechanic, an operator, a consultant, a contractor, and a manufacturer's representative.

In one or more exemplary embodiments, the device located inside the explosion-proof enclosure is configured to control one or more elements. An element may be associated with, and/or located within, the explosion-proof enclosure. An element may be a VFD, sensor, wiring, terminal, switch, handle, indicating light, duct, and/or other component.

In one or more exemplary embodiments, an explosion-proof enclosure (also known as a flame-proof enclosure) is an enclosure that is configured to contain an explosion that originates inside the enclosure. Further, the explosion-proof enclosure is configured to allow gases from inside the enclosure to escape across joints of the enclosure and cool as the gases exit the explosion-proof enclosure. The joints are also known as flame paths and exist where two surfaces meet and provide a path, from inside the explosion-proof enclosure to outside the explosion-proof enclosure, along which one or more gases may travel. A joint may be a mating of any two or more surfaces. Each surface of a flame path may be any type of surface, including but not limited to a flat surface, a threaded surface, and a serrated surface.

In one or more exemplary embodiments, a flame path is a type of sealing surface. A sealing surface may be configured to isolate one or more components from one or more operational and/or environmental factors. In such a case, the operational and/or environmental factors may include, but are not limited to, water, gas, electricity, heat, air flow, and magnetism. As an example, a sealing surface may be a transparent rubber coating that is applied to some or all of a keypad mounted to the outer surface of the door of an explosion-proof enclosure, where the transparent rubber coating keeps water out while allowing the keypad (and, specifically, the pushbuttons of the keypad) to operate. As another example, a sealing surface may exist where a plate is slidably coupled to an inner surface of the door of an explosion-proof enclosure. In such a case, the sealing surface may not only provide a flame path that allows gases from inside the enclosure to escape and cool as the gases exit the explosion-proof enclosure, but also provide a barrier to keep dust and water from entering the explosion-proof enclosure.

In one or more exemplary embodiments, an explosion-proof enclosure is subject to meeting certain standards and/or requirements. For example, the NEMA sets standards by which an enclosure must comply in order to qualify as an explosion-proof enclosure. Specifically, NEMA Type 7, Type 8, Type 9, and Type 10 enclosures set standards by which an explosion-proof enclosure within a hazardous location must comply. For example, a NEMA Type 7 standard applies to enclosures constructed for indoor use in certain hazardous locations. Hazardous locations may be defined by one or more of a number of authorities, including but not limited to the National Electric Code (e.g., Class 1, Division I) and Underwriters' Laboratories, Inc. (e.g., UL 698). For example, a Class 1 hazardous area under the National Electric Code is an area in which flammable gases or vapors may be present in the air in sufficient quantities to be explosive.

As a specific example, NEMA standards for an explosion-proof enclosure of a certain size or range of sizes may require that in a Group B, Division 1 area, any flame path of an explosion-proof enclosure must be at least 1 inch long (continuous and without interruption), and the gap between the surfaces cannot exceed 0.0015 inches. Standards created and maintained by NEMA may be found at www.nema.org/stds and are hereby incorporated by reference.

Figure 2:
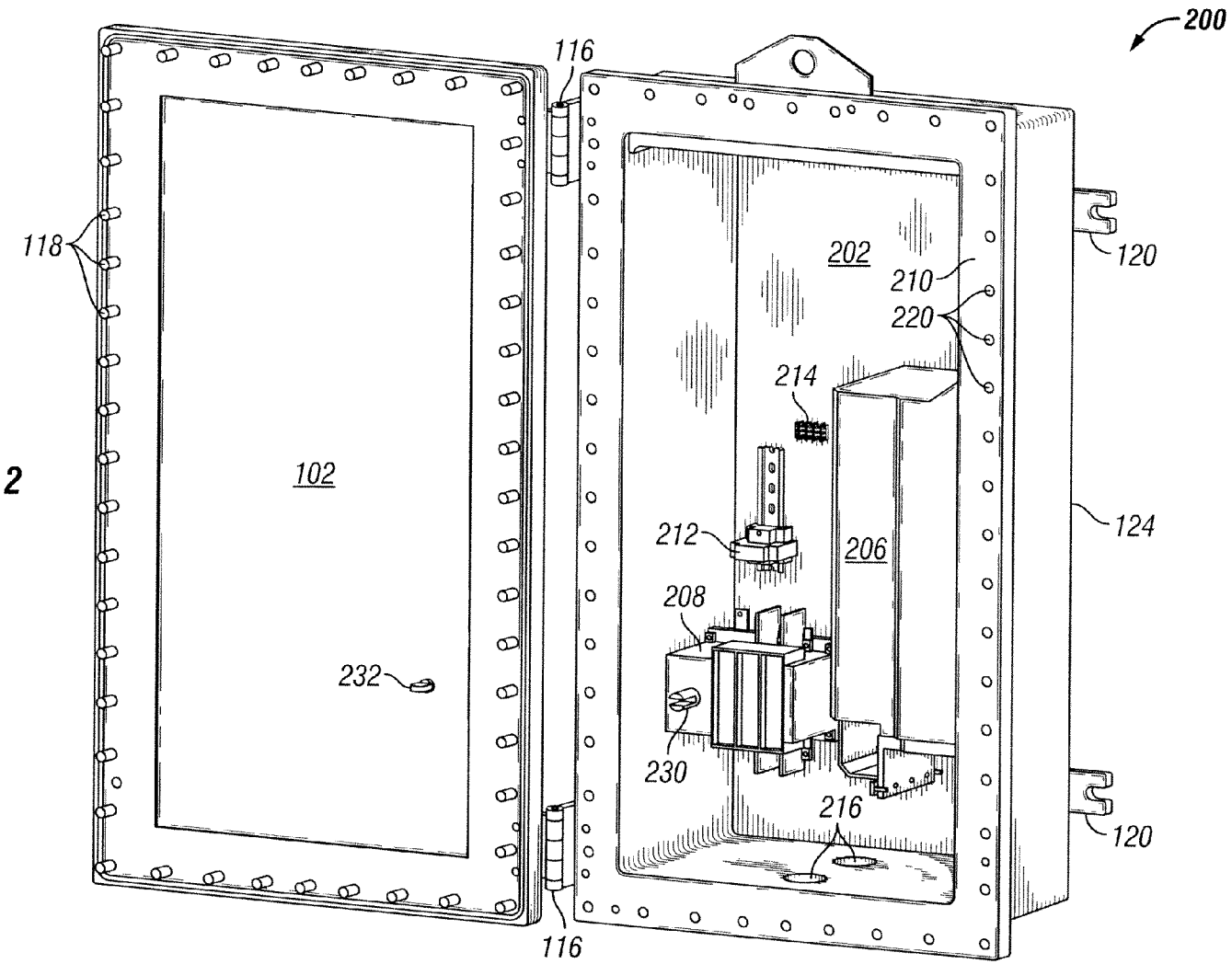

FIGS. 1 and 2 depict an explosion-proof enclosure 100 in which one or more exemplary embodiments of actuating multiple features of a device within an explosion-proof enclosure may be implemented. In one or more exemplary embodiments, one or more of the components shown in FIGS. 1 and 2 may be omitted, repeated, and/or substituted. Accordingly, exemplary embodiments of an explosion-proof enclosure should not be considered limited to the specific arrangements of components shown in FIGS. 1 and 2.

Referring now to FIG. 1, an example of an explosion-proof enclosure 100 in a closed position is shown. The enclosure cover 102 is secured to the enclosure body 124 by a number of fastening devices 118 located at a number of points around the perimeter of the enclosure cover 102. In one or more exemplary embodiments, a fastening device 118 may be one or more of a number of fastening devices, including but not limited to a bolt (which may be coupled with a nut), a screw (which may be coupled with a nut), and a clamp. In addition, one or more hinges 116 are secured to one side of the enclosure cover 102 and a corresponding side of the enclosure body 124 so that, when all of the fastening devices 118 are removed, the enclosure cover 102 may swing outward (i.e., an open position) from the enclosure body 124 using the one or more hinges 116. In one or more exemplary embodiments, there are no hinges, and the enclosure cover 102 is separated from the enclosure body 124 when all of the fastening devices 118 are removed.

The enclosure cover 102 and the enclosure body 124 may be made of any suitable material, including metal (e.g., alloy, stainless steel), plastic, some other material, or any combination thereof. The enclosure cover 102 and the enclosure body 124 may be made of the same material or different materials.

In one or more exemplary embodiments, on the end of the enclosure body 124 opposite the enclosure cover 102, one or more mounting brackets 120 are affixed to the exterior of the enclosure body 124 to facilitate mounting the enclosure 100. Using the mounting brackets 120, the enclosure 100 may be mounted to one or more of a number of surfaces and/or elements, including but not limited to a wall, a control cabinet, a cement block, an I-beam, and a U-bracket.

The enclosure cover 102 may include one or more features that allow for user interaction while the enclosure 100 is sealed in the closed position. As shown in FIG. 1, one or more indicating lights (e.g., indicating light 1 106, indicting light 2 108) may be located on the enclosure cover 102. Each indicating light may be used to indicate a status of a feature or process associated with equipment inside the enclosure 100. For example, an indicating light may show a constant green light if a motor controlled by a VFD inside the enclosure 100 is operating. As another example, an indicating light may flash red when a motor controlled by a VFD inside the enclosure 100 has a problem (e.g., tripped circuit, VFD overheats, overcurrent situation). As another example, an indicating light may show a constant red light when an electromagnetic pulse caused by an explosion inside the enclosure 100 has resulted. An indicating light may be made of one or more materials (e.g., glass, plastic) using one or more different lighting sources (e.g., light-emitting diode (LED), incandescent bulb).

In one or more exemplary embodiments, the enclosure cover 102 may also include a switch handle 112 that allows a user to operate a switch (not shown) located inside the explosion-proof enclosure 100 while the explosion-proof enclosure 110 is closed. Those skilled in the art will appreciate that the switch handle 112 may be used for any type of switch. Each position (e.g., OFF, ON, HOLD, RESET) of the switch may be indicated by a switch position indicator 114 positioned adjacent to the switch handle 112 on the outer surface of the enclosure cover 102. A switch associated with the switch handle 112 and the switch position indicator 114 may be used to electrically and/or mechanically isolate, and/or change the mode of operation of, one or more components inside or associated with the explosion-proof enclosure 100. For example, the switch handle 112 may point to "OFF" on the switch position indicator 114 when a disconnect switch located inside the explosion-proof enclosure 100 is disengaged. In such a case, all equipment located inside the explosion-proof enclosure 100, as well as the equipment (e.g., a motor) controlled by the equipment located inside the explosion-proof enclosure 100, may be without power.

Referring now to FIG. 2, an example of an explosion-proof enclosure 100 in an open position in accordance with one or more exemplary embodiments is shown. The explosion-proof enclosure 100 is in the open position because the enclosure cover (not shown) is not secured to the enclosure body 124. The hinges 116 attached to the left side of the enclosure body 124 are also attached to the left side of the enclosure cover, which is swung outward from the enclosure body 124. Because the explosion-proof enclosure 100 is in the open position, the components of the explosion-proof enclosure 100 are visible to a user.

As described above with respect to FIG. 1, the enclosure body 124 includes two or more mounting brackets 120. In addition, in one or more exemplary embodiments, the enclosure body 124 includes an enclosure engagement surface 210, against which the enclosure cover meets when the explosion-proof enclosure 100 is in the closed position. A number of fastening device apertures 220 are shown around the enclosure engagement surface 210, where each of the fastening device apertures 220 are configured to receive a fastening device 118 that traverses through the enclosure cover 102, as described above with respect to FIG. 1. The number of fastening device apertures 220 may vary, depending on one or more of a number of factors, including but not limited to the size of the fastening device apertures 220, a standard that the explosion-proof enclosure 100 meets, and the type of fastening device 118 used. The number of fastening device apertures 220 may be zero.

In one or more exemplary embodiments, the explosion-proof enclosure 100 of FIG. 2 includes a mounting plate 202 that is affixed to the back of the inside of the explosion-proof enclosure 100. The mounting plate 202 may be configured to receive one or more components such that the one or more components are affixed to the mounting plate 202. The mounting plate 202 may include one or more apertures configured to receive securing devices that may be used to affix a component to the mounting plate 202. The mounting plate 202 may be made of any suitable material, including but not limited to the material of the enclosure body 124. In one or more exemplary embodiments, some or all of the one or more components may be mounted directly to an inside wall of the explosion-proof enclosure 100 rather than to the mounting plate 202.

In one or more exemplary embodiments, a VFD 206 is affixed to the mounting plate 202 inside the explosion-proof enclosure 100. The VFD 206 may include any components used to drive a motor and/or other device using variable control signals for controlled starts, stops, and/or operations of the motor and/or other devices. Examples of components of a VFD include, but are not limited to, discrete relays, a programmable logic controller (PLC), a programmable logic relay (PLR), an uninterruptible power supply (UPS), and a distributed control system (DCS). In one or more exemplary embodiments, one or more components of the VFD may replace the VFD. For example, the VFD may be substituted by one or more PLCs, one or more PLRs, one or more UPSs, one or more DCSs, and/or other heat-generating components.

In one or more exemplary embodiments, a switch 208 is affixed to the mounting plate 202 inside the explosion-proof enclosure 100. The switch 208 may be configured to electrically and/or mechanically isolate, and/or change the mode of operation of, one or more components located inside the explosion-proof enclosure 100 and/or one or more components located outside the explosion-proof enclosure 100. The switch 208 may be any type of switch, including but not limited to a disconnect switch, a test switch, a reset switch, an indicator switch, and a relay switch. For example, the switch 208 may be a disconnect switch that is used to cut off power to all components in the explosion-proof enclosure 100 and all devices located outside the explosion-proof enclosure 100 that are controlled by the components inside the explosion-proof enclosure 100. As another example, the switch 208 may be a bypass switch that is used to deactivate a protection scheme (e.g., a relay) or some other particular component or group of components located inside the explosion-proof enclosure 100.

The switch 208 may further be configured to receive, through mechanical and/or electrical means, a directive to change states (e.g., open, closed, hold) from a component located on the enclosure cover. For example, if the enclosure cover includes a switch handle (as described above with respect to FIG. 1), then a switch handle shaft 232 may extend from the switch handle through the enclosure cover to a switch coupling 230 of the switch 208. When the explosion-proof enclosure 100 is in the closed position, the switch handle shaft 232 couples with the switch coupling 230, and switch 208 may be operated by operating the switch handle located outside the explosion-proof enclosure, as described above with respect to FIG. 1.

In one or more exemplary embodiments, one or more relays (e.g., relay 212) are affixed to the mounting plate 202 inside the explosion-proof enclosure 100. A relay 212 may be configured to control one or more operations of one or more components located in, or associated with, the explosion-proof enclosure 100. Specifically, a relay 212 may, through one or more relay contacts, allow electrical current to flow and/or stop electrical current from flowing to one or more components in the enclosure 100 based on whether a coil of the relay 212 is energized or not. For example, if the coil of the relay 212 is energized, then a contact on the relay may be closed to allow current to flow to energize a motor. The relay 212 may be activated based on a timer, a current, a voltage, some other suitable activation method, or any combination thereof. The relay 212 may also be configured to emit a signal when a condition has occurred. For example, the relay 212 may flash a red light to indicate that the VFD 206 is in an alarm state.

In one or more exemplary embodiments, wiring terminals 214 are affixed to the mounting plate 202 inside the explosion-proof enclosure 100. Wiring terminals 214 are a series of terminals where one terminal is electrically connected to at least one other terminal in the series of terminals while remaining electrically isolated from the remaining terminals in the series of terminals. In other words, two or more terminals among the series of terminals act as a junction point where multiple wires may be electrically connected through the joined terminals.

In one or more exemplary embodiments, one or more entry holes 216 may extend through one or more sides (e.g., bottom) of the enclosure body 124. Each entry hole 216 may be configured to allow cables and/or wiring for power, control, and/or communications to pass through from outside the explosion-proof enclosure 100 to one or more components inside the explosion-proof enclosure 100. An entry hole 216 may be joined with a conduit and coupling from outside the explosion-proof enclosure 100 to protect the cables and/or wiring received by the entry hole 216 and to help maintain the integrity of the explosion-proof enclosure 100 through the entry hole 216.

Figure 3A:
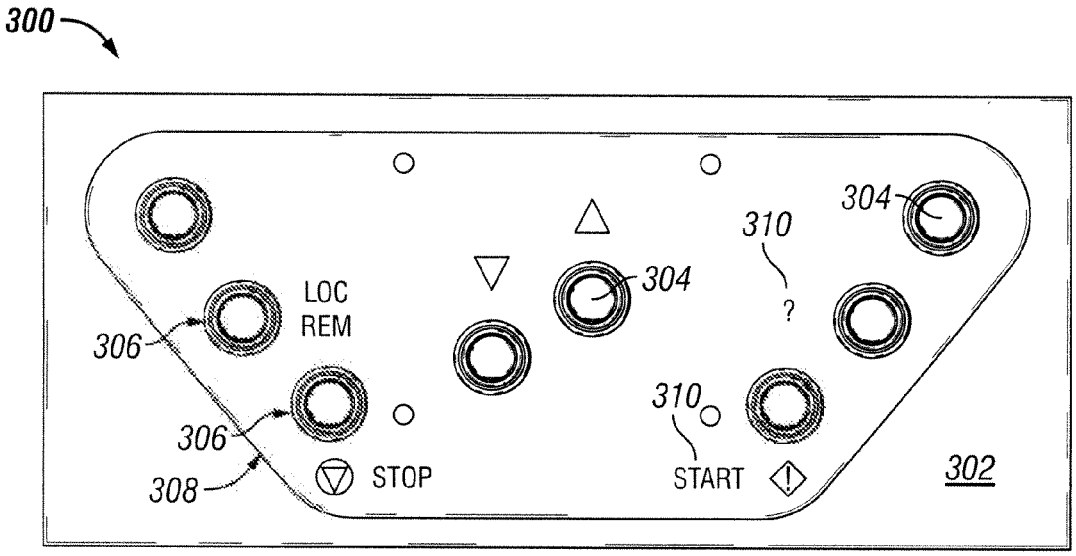
FIGS. 3A through 3C show various examples of portions of keypad in accordance with one or more exemplary embodiments of actuating multiple features of a device inside an explosion-proof enclosure.
Figure 3B:
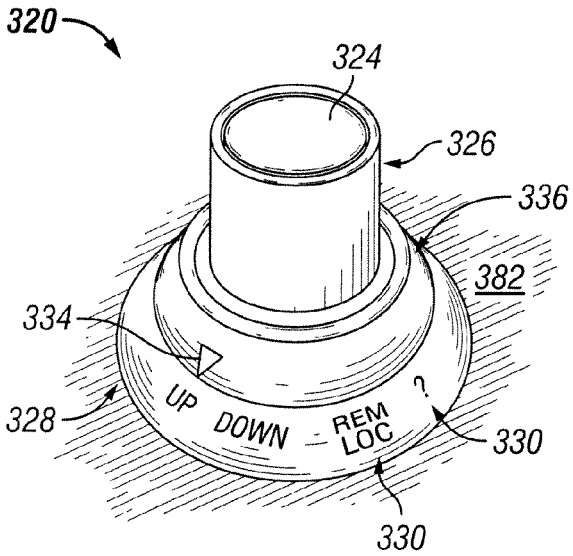
Figure 3C:
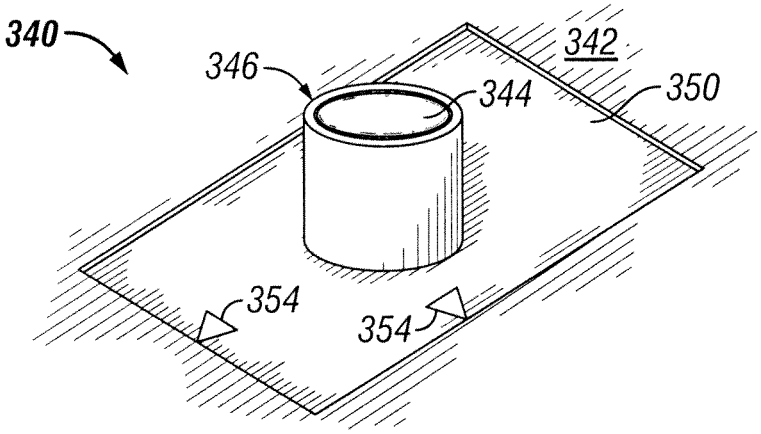

FIGS. 3A through 3C show various examples of portions of a keypad in accordance with one or more exemplary embodiments. In each case, the portion of the keypads shown in FIGS. 3A through 3C are mounted on the outside of an explosion-proof enclosure. Each of these views of portions of a keypad is described below. Exemplary embodiments of actuating multiple features of a device located inside an explosion-proof enclosure are not limited to the configurations shown in FIGS. 3A through 3C and discussed herein.

FIG. 3A shows a frontal view of keypad 1 300 mounted on a surface 302 of an explosion-proof enclosure. Keypad 1 300 includes eight pushbuttons 304 which are each encased in a bearing 306 that protrude through the legend 308. In this example, the top of each pushbutton 304 in an undepressed state extends further away from the surface 302 than the corresponding bearing 306. The legend 308 includes a number of legend labels 310 that correspond to a pushbutton 304. For example, the pushbutton 304 on the lower right portion of keypad 1 300 corresponds to the legend label 310 entitled "START."

In FIG. 3B, keypad 2 320 mounted on the surface 322 of an explosion-proof enclosure includes a single pushbutton 324 with a bearing 326. The top of the pushbutton 324 in the undepressed state in this example is approximately flush with the top of the bearing 326. Keypad 2 320 also includes a rotatable collar 336 that may or may not be fixed to the bearing 326. The collar 336 includes an indicator 334 that aligns with one or a number of states (corresponding to one or more features of the device) shown on the legend 328. Specifically, each state is denoted by a legend label 330 on the legend 328 that surrounds at least a portion of the collar 336 on the surface 322 of an explosion-proof enclosure. The states denoted by a legend label 330 in FIG. 3B are "up," "down," "rem/loc," and "?" (for help).

In FIG. 3C, keypad 3 340 is mounted on a plate 350, where the plate 350 is slidably coupled to an underside of the surface 342 of an explosion-proof enclosure to occupy one of a number of positions. Each position occupied by the plate 350 (and thus the depressor coupled to the plate 350) may correspond to a device feature of the device located inside the explosion-proof enclosure. In this case, keypad 3 340 is a single depressor. The surface 342 has an aperture with dimensions. For example, the aperture in the surface 342 may be a 2 inch by 3 inch rectangle.

The plate 350 may have a shape substantially similar to the aperture of the surface 342. In any case, the plate 350 has dimensions that are larger than the dimensions of the aperture in the surface 342. For example, when the aperture in the surface 342 is a 2 inch by 3 inch rectangle, the dimensions of the plate 350 may be a 4 inch by 6 inch rectangle. In one or more exemplary embodiments, the plate 350 covers the entire aperture in the surface 342, regardless of which position the plate 350 occupies. The plate 350 may be made of one or more of a number of suitable materials, including but not limited to the material of the surface 342, plastic, glass, and plexiglass.

The movement of the plate 350 may be subject to one or more detents in one or more directions. As shown in FIG. 3C, the plate 350 may slide perpendicular to either of the sides of the rectangular aperture in the surface 342. The position of the plate 350 is denoted in FIG. 3C by two indicators 354, which may correspond to a legend (not shown) affixed to the surface 342. In one or more exemplary embodiments, when the plate 350 is made of a transparent material (e.g., glass), there may be no legend affixed to the surface 342 because a user may be able to visually determine the position of the plate 350 (and thus the function that may be performed by depressing a particular depressor or a depressor in a certain position).

In one or more exemplary embodiments, a flame path is formed between the underside of the surface 342 and the top side of the plate 350. In other words, the gap between the underside of the surface 342 and the top side of the plate 350 is tight enough so as to cool combustible gases while exiting from inside the explosion-proof enclosure. In addition, a flame path may be formed, instead of or in addition to the flame path described above, where the bearing 346 of the depressor is coupled to the aperture in the plate 350 and/or between the bearing 346 and the pushbutton 344 of the depressor.

For each keypad shown in FIGS. 3A through 3C, the materials (e.g., plastic, metal, wood, rubber, a composite material, fiberglass) used for the various components (e.g., pushbutton, bearing, collar, plate) are suitable for maintaining the integrity of an explosion-proof enclosure while also retaining functional reliability for the task performed by such component. Further, for each keypad shown in FIGS. 3A through 3C, the bearing may be fixedly coupled to the surface and/or plate of the explosion-proof enclosure using one or more coupling techniques, including but not limited to bolting, welding, mating threads, using epoxy, brazing, press fitting, mechanically connecting, using a flat joint, and using a serrated joint.

FIGS. 4A through 4E show various views of an exemplary system 400 for actuating multiple features of a device located inside an explosion-proof enclosure in accordance with one or more exemplary embodiments. Each of the various views of the exemplary system 400 shown in FIGS. 4A through 4E is described below. Features, elements, and/or components shown but not described and/or labeled in FIGS. 4A through 4E are described and/or labeled above with respect to FIGS. 3A through 3C. Exemplary embodiments of actuating multiple features of a device located inside an explosion-proof enclosure are not limited to the configurations shown in FIGS. 4A through 4E and discussed herein.

Figure 4A:
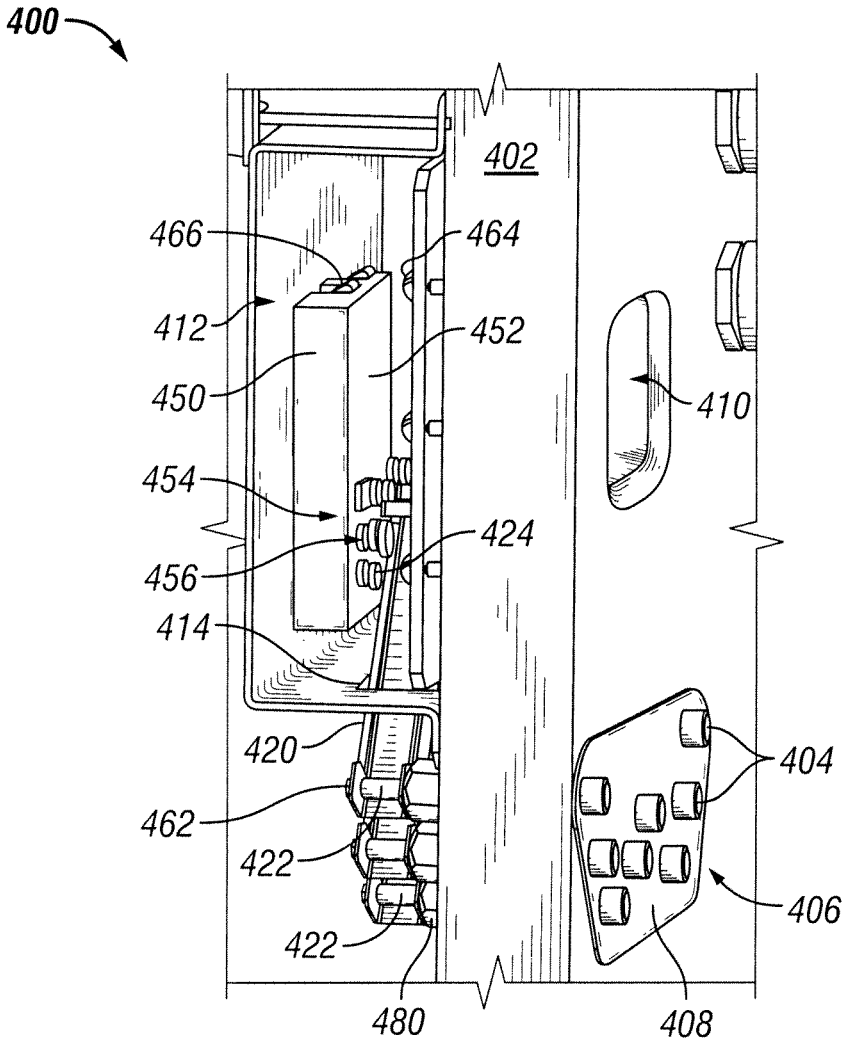
FIGS. 4A through 4E show various views of a system for actuating multiple features of a device located inside an explosion-proof enclosure in accordance with one or more exemplary embodiments.

FIG. 4A shows a frontal-side view of the system 400 looking from the non-hinged edge of the door (which includes the surface 402) of the explosion-proof enclosure toward the hinged edge of the door of the explosion-proof enclosure. A keypad 406 with pushbuttons 404 and a legend 408, substantially similar to the keypad of FIG. 3A, is shown in FIG. 4A.

Each depressor in this example includes a pushbutton 404, a bearing 480 that extends through an aperture in the surface 402 and is coupled to the surface 402 along the perimeter of the aperture, and a stem 422. A depressor may also include a shaft (shown in FIG. 4D) that is coupled to the pushbutton 404 and is configured to slide within the bearing 480 as the pushbutton 404 moves between a depressed state and an undepressed state.

The device 450 in this example includes a device display 452 and a device interface 454, which includes one or more device features 456. In one or more exemplary embodiments, a device feature 456 of the device 450 is any component (e.g., pushbutton, key, sensor, switch) that is configured to detect an actuation (e.g., physically depressing a button, hovering a depressor within a certain distance of a sensing device). The device feature 456 may be mechanically-actuating, electronically-actuating, actuating based on some other suitable principle (e.g., pneumatics), or any combination thereof. When the device feature 456 is actuated, the device 450 executes pre-programmed instructions in response to actuation of the device feature 456. The pre-programmed instructions may be associated with an element (e.g., VFD) that is controlled by the device 450.

The device display 452 may be used to display information associated with the device 450. Such information may be associated with the operation of the device 450, a menu, communication with a user based on a pushbutton 404 on the keypad 406 that have been depressed, some other suitable information, or any combination thereof. The viewing window 410 traverses a portion of the surface 402 at a location adjacent to the keypad 406. The viewing window 410 allows a user to see the device display 452 without opening the explosion-proof enclosure.

When a user presses a pushbutton 404 on the keypad 406, the pushbutton 404 goes from an undepressed state to a depressed state. Consequently, a shaft (not shown, but described below) coupled to the pushbutton 404 is driven toward the interior of the explosion-proof enclosure. The shaft is, in turn, orthogonally coupled to a cantilever 420 by a stem 422 that protrudes through at least a portion of the cantilever 420. The stem is secured to the cantilever 420 by fastening device 1 462. As the shaft coupled to the pushbutton 404 is driven toward the interior of the explosion-proof enclosure, the cantilever 420 also moves.

In one or more exemplary embodiments, a cantilever 420 is a component that is configured to be fixed at one end and translate a force across its shaft to the other end. The force translated by the cantilever 420 may originate outside of an explosion-proof enclosure to actuate one or more device features of a device located inside the explosion-proof enclosure. For example, a cantilever 420 may be coupled at one end to a shaft (for example, a stem 422) of a depressor (which includes a pushbutton 404) so that the opposite end of the cantilever 420 may actuate a device feature 456 (e.g., press a pushbutton) on a device 450.

Each cantilever 420 extends into a bracket 412 through a hole in the bottom of the bracket 412, where the hole is defined by one or more cantilever guides 414. The cantilever guides 414 (and associated holes) may be particularly located and/or oriented in the bottom of the bracket 412 based on a location of the cantilever 420 coupled to the stem 422 as well as the location of the associated feature on the device interface 454 of the device 450 located within the bracket 412 inside the explosion-proof enclosure. In other words, the location and/or orientation of a cantilever guide 414 may be based on aligning one end of the cantilever 420 coupled to a pushbutton 404 and the other end of the cantilever 420 (i.e., the stepped feature 424), located inside the bracket 412, with a device feature 456 on the device interface 454 of the device 450. The stepped feature 424 of the cantilever 420 provides clearance between the cantilevers 420 and ensures solid contact with the associated device feature 456 on the device interface 454 of the device 450.

The device 450 is mounted to the bracket 412 by one or more of fastening device 3 466. The bracket 412 is mounted to the surface 402 inside the explosion-proof enclosure using one or more of fastening device 2 464. The bracket serves one or more of a number of functions, including but not limited to securing the keypad 406, guiding the operating fingers (e.g., cantilever, depressor), controlling the travel distance of the operating fingers in both directions, and preventing overtravel of the operating fingers.

Figure 4C:
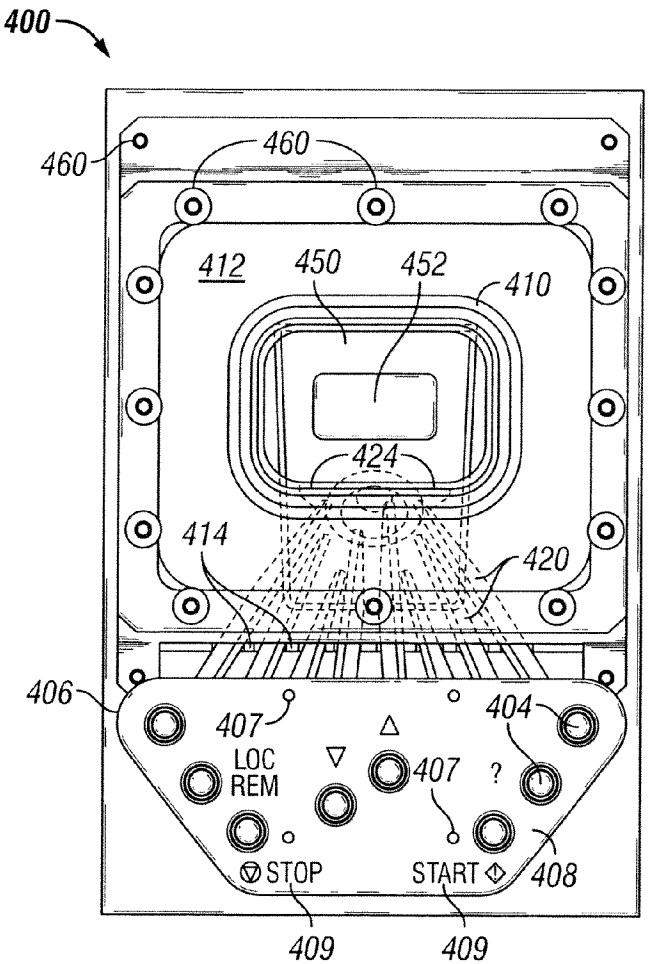
Figure 4B:
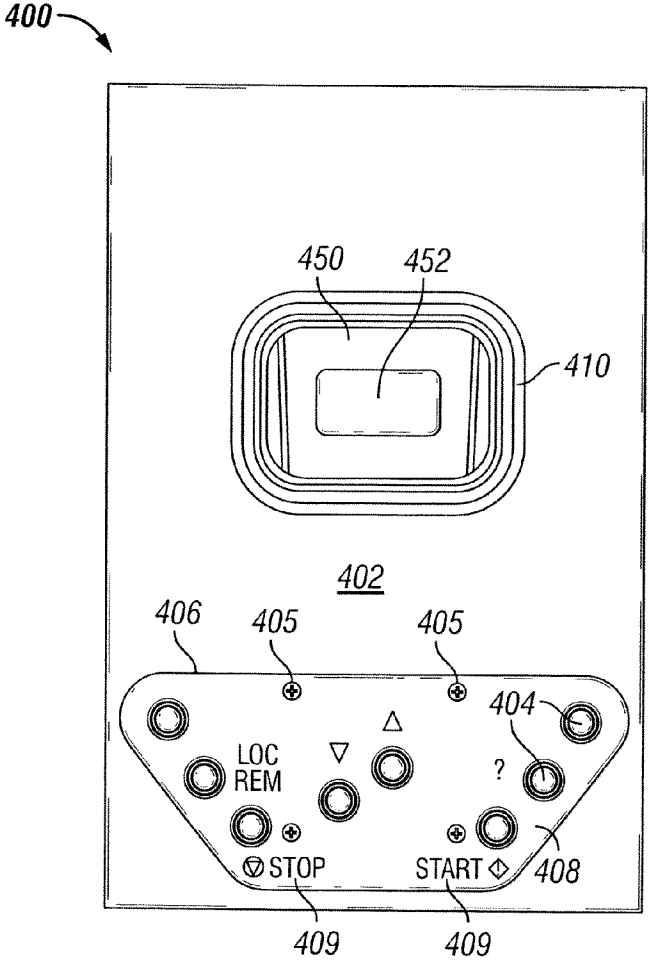

FIG. 4B shows a front view of the exemplary system 400 for actuating multiple features of a device located inside an explosion-proof enclosure in accordance with one or more exemplary embodiments. Specifically, the keypad 406 is shown mounted to the surface 402 outside of the explosion-proof enclosure using several keypad fasteners 405. In this case, the keypad fasteners 405 are screws. The keypad fasteners 405 may also be any suitable fastening mechanism, either in addition to or instead of screws, including but not limited to bolts, epoxy, clamps, and clips.

The keypad 406 shown in FIG. 4B is substantially similar to the keypad shown in FIG. 3A. The keypad 406 includes a legend 408 with a number of legend labels 409 and a number of apertures through which pushbuttons 404 are positioned. As shown, a legend label 409 is associated with each pushbutton 404 on the keypad 406.

Also shown in FIG. 4B is a viewing window 410 mounted within an aperture of the surface 402 of the explosion-proof enclosure. The viewing window 410 is configured to allow a user to view the device display 452 of the device 450 inside the explosion-proof enclosure without opening the explosion-proof enclosure.

FIG. 4C shows a multi-layer frontal view of the exemplary system 400 for actuating multiple features of a device located inside an explosion-proof enclosure in accordance with one or more exemplary embodiments. The front layer shown in FIG. 4C is substantially similar to FIG. 4B described above, except that the surface 402 of the explosion-proof enclosure and the keypad fasteners are removed from FIG. 4C. With the keypad fasteners removed, the keypad fastening apertures 407 are shown in FIG. 4C.

Because the surface 402 of the explosion-proof enclosure is removed, various components located inside the explosion-proof enclosure are shown in FIG. 4C in transparent layers. Specifically, a cantilever 420 is shown extending behind the keypad 406, with one cantilever 420 for each pushbutton 404. Each cantilever 420 extends through cantilever guides 414 built into the bottom potion of the bracket 412. The end of each cantilever 420 opposite the coupling to the depressor (e.g., pushbutton 404) terminates inside the bracket 412 and has a stepped feature 424 proximate to one or more device features on the device interface (not shown in FIG. 4C) on the device 450.

In this exemplary embodiment, the operating fingers (i.e., cantilevers 420) are arranged in a comb-like design. In other words, the cantilevers 420 are nested to avoid physical interference with one another and to allow actuation of one or more features of the device 450 while being in close proximity to each other. In one or more exemplary embodiments, the cantilevers 420 are arranged in such a way that the size, dimensions, features, and composition may be substantially identical to each other.

The device 450 shown in FIG. 4C includes a device display 452, which may be seen from outside the explosion-proof enclosure (when the explosion-proof enclosure is closed) through the viewing window 410. Further, FIG. 4C shows a number of bracket fastening apertures 460 used to couple the bracket 412 to the surface inside the explosion-proof enclosure.

Figure 4D:
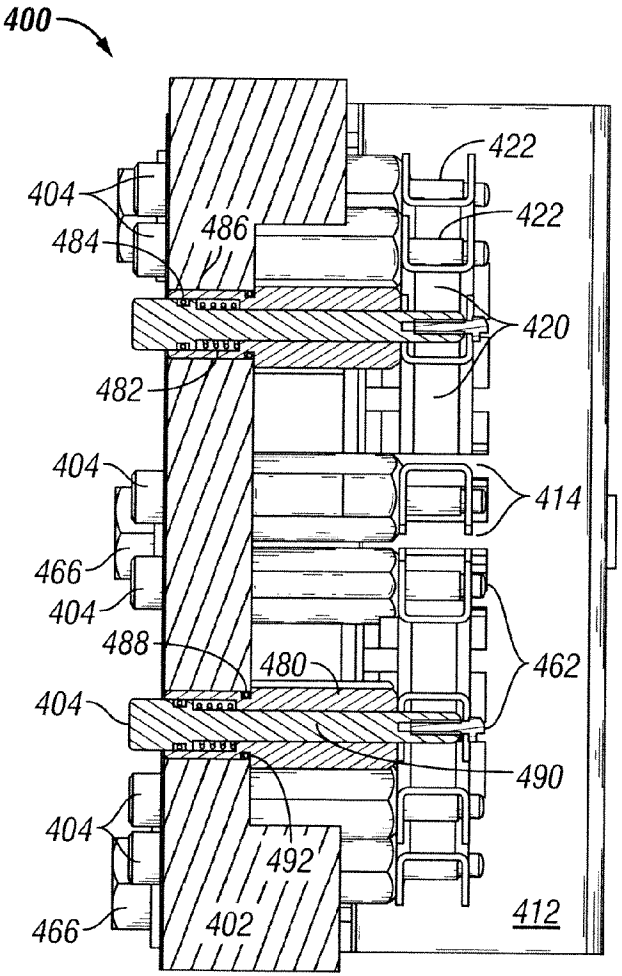

FIG. 4D shows a cross-sectional bottom view of the exemplary system 400 for actuating multiple features of a device located inside an explosion-proof enclosure in accordance with one or more exemplary embodiments. Among other features, FIG. 4D shows the various elements of a depressor in accordance with one or more exemplary embodiments of the invention.

Specifically, a number of depressors are shown extending through apertures in the surface 402. Each depressor shown in FIG. 4D includes a pushbutton 404 that extends through the surface 402 on the outside of the explosion-proof enclosure. A notch is etched around the circumference of the pushbutton 404 and filled with a sealing element 484. The sealing element 484 may be any element (e.g., o-ring, gasket) that provides a seal while still allowing the pushbutton to travel between a depressed state and an undepressed state. The sealing element 484 may be any suitable shape to provide a seal and may be made of one or more of any suitable material, including but not limited to rubber, plastic, metal, and silicon.

The depressor shown in FIG. 4D also includes a shaft 490 and a bearing 480. Specifically, the shaft 490 is coupled to each pushbutton and is positioned within an aperture that traverses the length of the bearing 480. The bearing 480 may be configured to secure the pushbutton 404 to the explosion-proof enclosure and to direct the shaft 490 so that, when the pushbutton 404 is in a depressed state, the corresponding device feature on the device is activated. As the pushbutton 404 moves between a depressed state and an undepressed state, the pushbutton 404 and the shaft 490 slide within the bearing 480. In one or more exemplary embodiments, the sealing element 484 is located within the aperture of the bearing 480.

Also positioned inside the aperture of the bearing 480 is a compressible element 482 that is configured to limit the extent to which the pushbutton 404 is moved to a depressed state and to return the pushbutton 404 to an undepressed state from the depressed state. In one or more exemplary embodiments, the compressible element 482 is in a normal state when the pushbutton 404 is in an undepressed state. Further, the compressible element 482 may be in a compressed state when the pushbutton 404 is in a depressed state. The compressible element 482 may be a spring, a seal, compressible rubber, some other suitable configuration, or any combination thereof The compressible element 482 may be any suitable shape to provide limits to the movement of the pushbutton 404 and may be made of one or more of any suitable material, including but not limited to rubber, plastic, metal, and silicon. The compressible element 482 may be located in one of a number of locations. For example, the compressible element 482 may be located inside the bearing 480 and around a portion of the shaft 490 on the underside of the pushbutton 404 (as shown). The compressible element 482 may also be located closer to the stem 422.

In one or more exemplary embodiments, each bearing 480 is fixedly coupled to an aperture in the surface 402 at a mating surface 486. The mating surface 486 of the outer portion of the bearing 480 and the inner portion of the aperture in the surface 402 may be of any shape and configuration so that the bearing 480 couples to the aperture in the surface 402. The bearing 480 may be fixedly coupled to the aperture in the surface 402 of the explosion-proof enclosure using one or more coupling techniques, including but not limited to bolting, welding, mating threads, using epoxy, brazing, press fitting, mechanically connecting, using a flat joint, and using a serrated joint.

In one or more exemplary embodiments, a relief 488 may be included to position the bearing 480 coupled to the aperture in the surface 402. The relief may be located in one of a number of locations, including but not limited to at the shoulder 492 (i.e., where the aperture of the surface 402 meets the surface 402 exposed to the interior of the explosion-proof enclosure, as shown in FIG. 4D) or at some other point in the inner portion of the aperture in the surface 402.

The depressor shown in FIG. 4D also includes a stem 422 that is coupled to the end of the shaft 490 opposite the pushbutton 404. The stem 422 may be sized and configured to couple to an operating finger. In this example, each stem 422 is coupled to a cantilever 420 using fastening device 1 462, which traverses an aperture in the cantilever 420 and is positioned within an aperture of the stem 422. Alternatively, the stem 422 may be an operating finger configured to contact one or more device features on a device.

Also, as described above, the cantilevers 420 are positioned inside the bracket 412 using cantilever guides 414 along the bottom of the bracket 412. As FIG. 4D shows, the cantilever guides 414 are configured to allow the cantilever to shift inward (to the right in FIG. 4D) so that the stepped feature (not shown) of the cantilever 420 may contact one or more device features on a device when the corresponding pushbutton 404 is depressed. Further, enclosure door fasteners 466, substantially similar to the fastening devices described above with respect to FIG. 1, are shown in FIG. 4D.

Figure 4E:
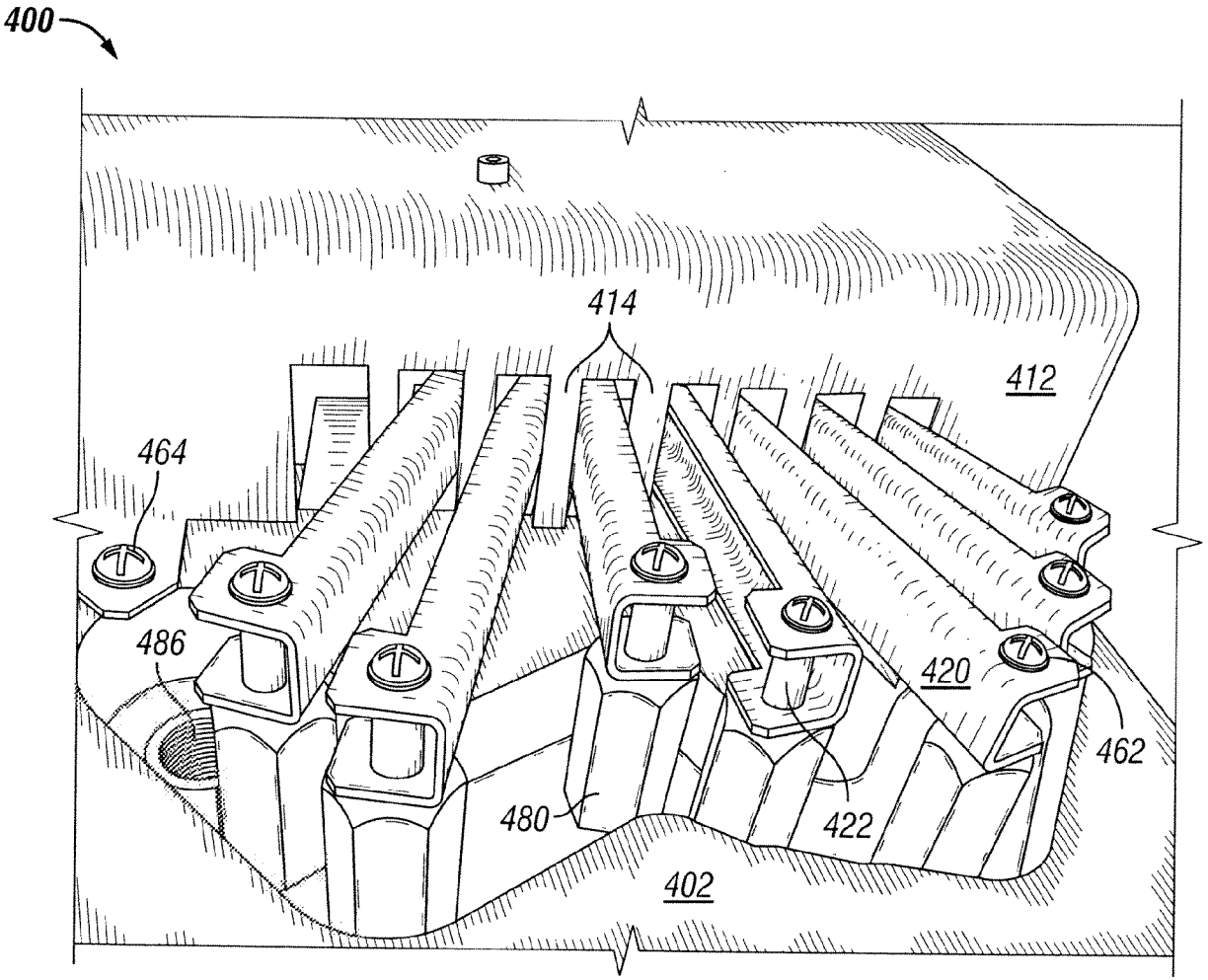

FIG. 4E shows a bottom view of the exemplary system 400 for actuating multiple features of a device located inside an explosion-proof enclosure in accordance with one or more exemplary embodiments. Many of the elements shown in FIG. 4D are also shown in FIG. 4E.

In FIG. 4E, seven bearings 480 are fixedly coupled to apertures in the surface 402 at a mating surface 486 using mating threads. One such aperture in the surface 402 is not coupled to a bearing 480. Through each bearing 480 is positioned a shaft (not shown), to which is connected a stem 422. Each stem 422 traverses an aperture in a lower support of a cantilever 420. Fastening device 1 462 traverses an aperture in an upper support of the cantilever and is fixedly coupled to the stem 422 to secure the stem 422 to the cantilever 420. In this example, fastening device 1 462 is a slotted screw.

Each cantilever 420 is aligned within the bracket 412 using cantilever guides 414 positioned along the bottom side of the bracket 412. Also, the bracket is coupled to the surface 402 using fastening device 2 464.

Figure 5:
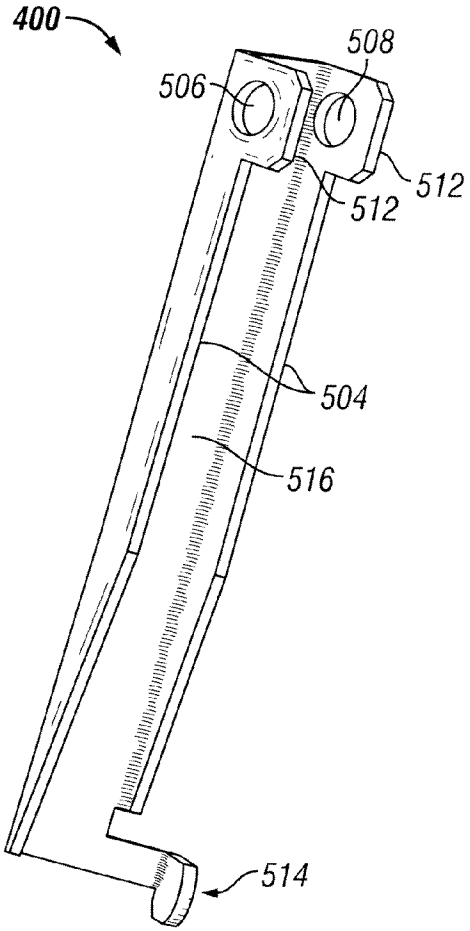
FIG. 5 shows a cantilever for actuating multiple features of a device located inside an explosion-proof enclosure in accordance with one or more exemplary embodiments.

FIG. 5 shows a cantilever 500 according to one or more exemplary embodiments. The exemplary cantilever 500 shown in FIG. 5 is described below. Features shown but not described and/or labeled in FIG. 5 are described and/or labeled above with respect to FIGS. 3A through 4E. Exemplary embodiments of a cantilever are not limited to the configurations shown in FIG. 5 and discussed herein.

The cantilever 500 shown in FIG. 5 includes, at one end, two supports 512 that each have an aperture (i.e., aperture 1 506 and aperture 2 508). In one or more exemplary embodiments, aperture 1 506 is configured to receive a stem of a depressor, and aperture 2 508 is configured to receive a fastening device to couple the stem to the cantilever 500. The supports 512 may be configured to provide rigidity to the cantilever 500 and to distribute force on the stem of a depressor.

At the opposite end of the cantilever 500 shown in FIG. 5 is a stepped feature 514 configured to contact one or more device features of a device interface on a device located inside an explosion-proof enclosure. The stepped feature 514 may be one of a variety of shapes and sizes. Connecting the stepped feature 514 to the supports 512 is a shaft 516 of the cantilever 500. The shaft 516 is reinforced by two side walls 504, oriented parallel to the supports 512, to provide added strength to the shaft 516.

The cantilever 500 may be constructed from one or more of a number of materials, including but not limited to stainless steel, galvanized steel, plastic, and aluminum. The cantilever 500 and/or any of the elements of the cantilever 500 may have any other configuration than the configuration shown in FIG. 5. Specifically, a cantilever may have a number of other shapes, dimensions, features, and elements than those shown in FIG. 5. The configuration of the cantilever 500 may depend on one or more of a number of factors, including but not limited to the distance (e.g., lateral, vertical) from the stem to the associated device feature on the device, the size and/or orientation of the cantilever guides in the bracket, the temperature inside the explosion-proof enclosure, and the minimum amount of force required to activate a device feature on a device when a depressor is depressed.

Figure 6:
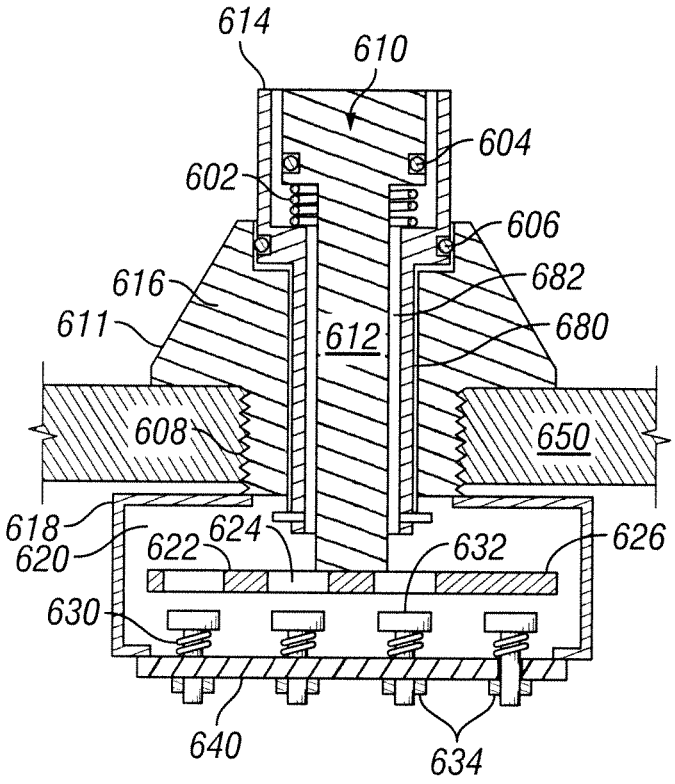
FIGS. 6 and 7 each show a system for actuating multiple features of a device located inside an explosion-proof enclosure in accordance with one or more exemplary embodiments.
Figure 7:
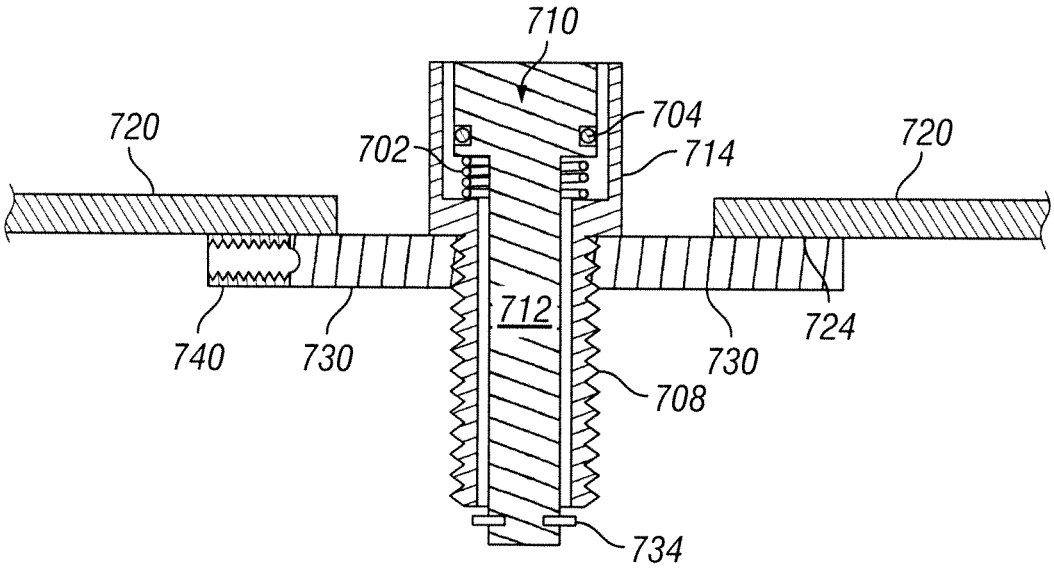

FIGS. 6 and 7 each show a system for actuating multiple features of a device located inside an explosion-proof enclosure in accordance with one or more exemplary embodiments. The exemplary systems shown in FIGS. 6 and 7 are described below. Features shown but not described and/or labeled in FIGS. 6 and 7 are described and/or labeled above with respect to FIGS. 3A through 5. Exemplary embodiments of actuating multiple features of a device located inside an explosion-proof enclosure are not limited to the configurations shown in FIGS. 6 and 7 and discussed herein.

In FIG. 6, a depressor is shown in accordance with one or more exemplary embodiments. Specifically, the depressor of FIG. 6 is substantially similar to the depressor of FIG. 3B described above. The depressor of FIG. 6 includes a pushbutton 610 coupled to a shaft 612 positioned within a bearing 614. A compressible element (i.e., compressible element 1 602) is positioned inside the bearing 614 and around the upper portion of the shaft 612 just below the pushbutton 610. In this example, the top of the bearing 614 is approximately the same height above the surface 650 outside the explosion-proof enclosure as the top of the pushbutton 610 in an undepressed state.

The bearing 614 of FIG. 6 includes a dial 616 that extends through the aperture in the surface 650 and is configured to rotate. The dial 616 may include, on a portion of the dial 616 that is located outside the explosion-proof enclosure, a face 617. The face 617 may include an indicator, substantially similar to the indicator described above with respect to FIG. 3B. The indicator on the face 617 may be rotated to two or more of a number of positions, where each position corresponds to one or more features of the device inside the explosion-proof enclosure. In one or more exemplary embodiments, each position of the indicator on the face 617 of the dial 616 may correspond to two or more indicating labels on an indicator coupled to the surface 650 outside the explosion-proof enclosure and located adjacent to the indicator on the dial 616.

The bearing 614 of FIG. 6 also includes a housing 618 coupled to the dial 616 and located inside the explosion-proof enclosure. The housing may also be coupled to (although not necessarily fixedly so) the bracket 640 inside of which the device is located. The housing 618 may include a cavity 620 and a template 622 that is rotatably coupled to the dial 616. The template 622 may be coupled to the shaft 612 so that the template 622 moves toward the bottom of the cavity 620 as the pushbutton 610 is moved to a depressed state. Likewise, the template 622 may move toward the middle of the cavity 620 as the pushbutton610 returns to an undepressed state.

The template 622 may include a number of apertures (e.g., template aperture 624) and segments (e.g., template segment 626) that align with two or more secondary depressors 632 protruding through apertures in the bracket 640. The secondary depressors 632 may be configured to actuate, either directly or indirectly, one or more device features of a device located inside the explosion-proof enclosure. As an example of an indirect actuation of a device feature, each secondary depressor 632 may be orthogonally coupled to a cantilever, which actuates at least one device feature on a device as described above.

As shown in FIG. 6, each secondary depressor 632 includes a compressible element (i.e., compressible element 2 630) that is configured to return a secondary depressor 632 from a depressed state (caused by a template segment 626 as the pushbutton 610 is moved to a depressed state) to an undepressed state. Each secondary depressor 632 may also include a stopper 634 coupled to the secondary depressor 632 inside the bracket 640 to keep the secondary depressor 632 positioned within its respective aperture in the bracket 640.

In FIG. 6, the template 622 is aligned such that, when the pushbutton 610 is moved to the depressed position, the template segment 626 depresses the secondary depressor 632 on the far right inside the cavity 620. In addition, the template apertures 624 of the template 622 align with the other three secondary depressors 632 shown in FIG. 6; consequently, when the pushbutton 610 is moved to the depressed position, the template apertures 624 pass over the other three secondary depressors 632, and so the other three secondary depressors 632 remain in an undepressed state.

In one or more exemplary embodiments, a flame path (e.g., flame path 1 680) exists between the dial 616 and the bearing 614. The width of flame path 1 680 may be controlled at a point by a sealing element (e.g., sealing element 2 606). In addition (or alternatively), a flame path (e.g., flame path 2 682) may exist between the bearing 614 and the shaft 612/pushbutton 610 combination. The width of flame path 2 682 may be controlled at a point by a sealing element (e.g., sealing element 1 604). One or more other flame paths may exist, in place of or in addition to the flame paths discussed above, at other locations in and around the depressor.

In FIG. 7, a depressor is shown in accordance with one or more exemplary embodiments. Specifically, the depressor of FIG. 7 is substantially similar to the depressor of FIG. 3C described above. The depressor of FIG. 7 includes a pushbutton 710 coupled to a shaft 712 positioned within a bearing 714. The pushbutton 710 may be configured to move between an undepressed state and a depressed state. In this example, the top of the bearing 714 is approximately the same height above the plate 730 outside the explosion-proof enclosure as the top of the pushbutton 710 in an undepressed state.

A compressible element (i.e., compressible element 702) is positioned inside the bearing 714 and around the upper portion of the shaft 712 just below the pushbutton 710. Further, a stopper 734 is coupled to the shaft 712 just below the end of the bearing 714. The stopper 734 may be configured to perform substantially the same functions as the stoppers described above with respect to FIG. 6.

The bearing 714 of the depressor in FIG. 7A is fixedly coupled to an aperture in the plate 730 at the mating surface 708. The plate 730 is slidably coupled to an underside of the surface 720 of the explosion-proof enclosure. The plate 730 may be configured to move to one of a number of positions. The movement of the plate 730 may be locked into a position by one or more detents 740 in one or more directions. The plate 730 may slide perpendicular to and/or parallel with the sides of the aperture in the surface 720.

In one or more exemplary embodiments, as the pushbutton 710 is depressed, the shaft travels toward the interior of the explosion-proof enclosure. The end of the shaft (i.e., opposite from where the shaft is coupled to the pushbutton 710) may be used to actuate, either directly or indirectly, at least one device feature of the device located inside the explosion-proof enclosure when the pushbutton 710 is in the depressed state. As an example of a direct actuation of a device feature, for each position of the plate 730, the end of the shaft 712 is placed slightly in front of a device feature on a device.

As an example of an indirect actuation of a device feature, each position of the plate 730 aligns the end of the shaft 712 (e.g., a stem) with one or more apertures in a cantilever, as described above with respect to FIG. 5. In one or more exemplary embodiments, a different cantilever is aligned with each position of the plate 730. In such a case, the end of the shaft 712 may be orthogonally coupled to a cantilever. When the pushbutton 710 is in a depressed state, the stepped feature of the cantilever is used to contact at least one device feature on a device.

In one or more exemplary embodiments, a flame path (e.g., flame path 1 724) is formed between the underside of the surface 720 and the top side of the plate 730. In other words, the gap between the underside of the surface 720 and the top side of the plate 730 is tight enough so as to cool combustible gases while exiting from inside the explosion-proof enclosure. A flame path (e.g., flame path 2 726) may also be formed between the bearing 714 and the shaft 712/pushbutton 710 combination. The width of flame path 2 726 may be controlled at a point by a sealing element (e.g., sealing element 704). One or more other flame paths may exist, in place of or in addition to the flame paths discussed above, at other locations in and around the depressor.

Figure 8:
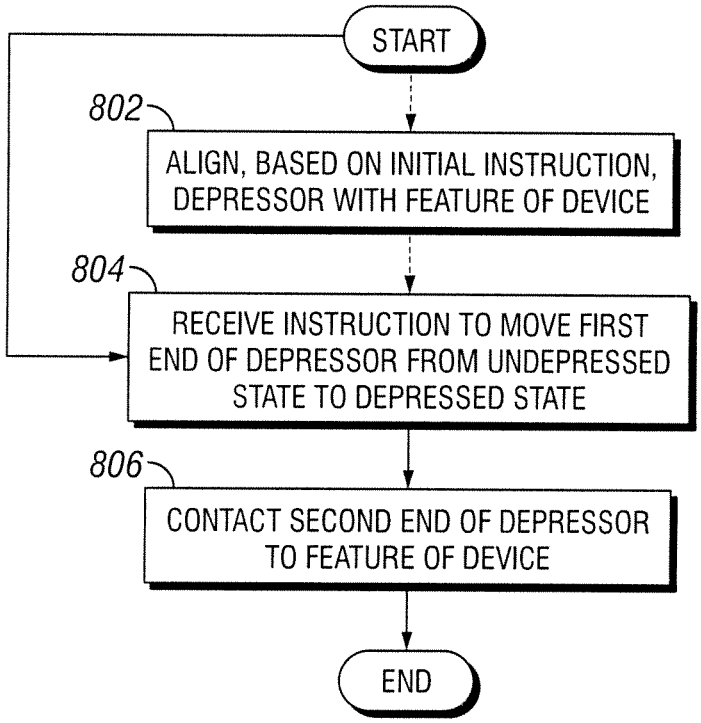
FIG. 8 shows a flowchart of a method for actuating at least one feature of a device located inside an explosion-proof enclosure in accordance with one or more exemplary embodiments.

FIG. 8 shows a flowchart of a method for actuating at least one feature of a device located inside an explosion-proof enclosure in accordance with one or more exemplary embodiments. While the various steps in this flowchart are presented and described sequentially, one of ordinary skill will appreciate that some or all of the steps may be executed in different orders, may be combined or omitted, and some or all of the steps may be executed in parallel. Further, in one or more of the exemplary embodiments of the invention, one or more of the steps described below may be omitted, repeated, and/or performed in a different order. In addition, a person of ordinary skill in the art will appreciate that additional steps, omitted in FIG. 8, may be included in performing this method. Accordingly, the specific arrangement of steps shown in FIG. 8 should not be construed as limiting the scope of the invention.

In optional Step 802, a depressor is aligned with at least one feature of multiple features of the device located inside the explosion-proof enclosure. The depressor may be aligned with the one or more features based on an initial instruction received. In one or more exemplary embodiments, the initial instruction may be received from a user. The initial instruction may involve some manipulation (e.g., pressing a button, rotating a dial, shifting a plate) of a depressor of a keypad.

For example, the initial instruction may be received when a dial, located on the outside of the explosion-proof enclosure and coupled to a depressor, may be rotated to align an indicator on the dial with a label on a legend. The legend may be affixed to an outer surface of the explosion-proof enclosure. The legend may also be adjacent to the dial. The label may correspond to the feature of the device in the explosion-proof enclosure that is being actuated.

As another example, the initial instruction may be received when a depressor is moved laterally to a position so that an end of the depressor corresponds to the feature of the device located inside the explosion-proof enclosure. The depressor may be moved laterally using a plate that is slidably coupled to an aperture in the surface. The plate may overlap the aperture in the surface and create a flame path where the plate is coupled to the underside of the surface.

In Step 804, an instruction is received to move a first end of the depressor from an undepressed state to a depressed state.

The instruction may be received from a user operating a keypad that includes the first end of the depressor. The keypad may be accessible from outside the explosion-proof enclosure. Also, the depressor may traverse an aperture in the explosion-proof enclosure. A flame path may be created where the depressor is coupled to the surface at the aperture of the surface.

In Step 806, a second end of the depressor contacts the feature of the device located inside the explosion-proof enclosure. The second end of the depressor may contact the feature while the first end of the depressor is in the depressed state. In one or more exemplary embodiments, the second end of the depressor may contact the feature by (1) extending, as the first end of the depressor is moved to the depressed state, the second end of the depressor, (2) moving, as the second end of the depressor is extended, a first cantilever end orthogonally coupled to the second end of the depressor, and (3) contacting, as the first cantilever end is moved, a second cantilever end to the feature of the device located inside the explosion-proof enclosure.

The following description (in conjunction with FIGS. 1 through 8) describes a few examples in accordance with one or more exemplary embodiments. The examples are for actuating at least one feature of a device located inside an explosion-proof enclosure. Terminology used in FIGS. 1 through 8 may be used in the example without further reference to FIGS. 1 through 8.

EXAMPLE 1

Figure 9A:
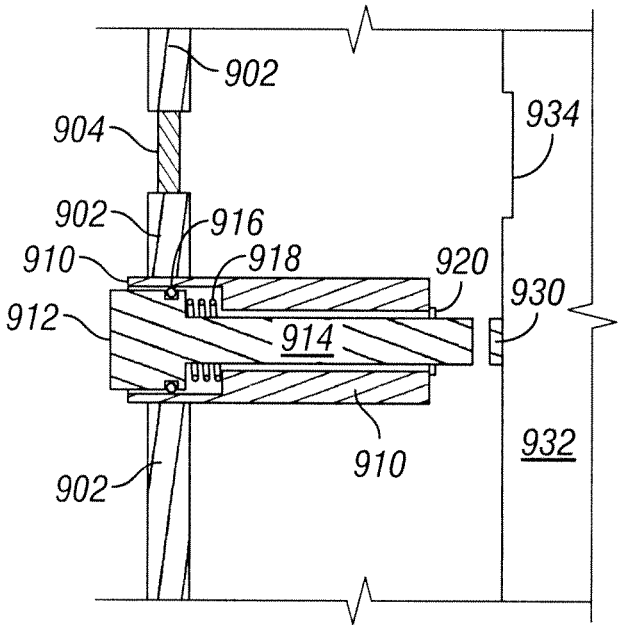
FIGS. 9A through 9D show an example in accordance with one or more exemplary embodiments.

Consider the following example, shown in FIGS. 9A through 9D, which describes actuating at least one feature of a device located inside an explosion-proof enclosure in accordance with one or more exemplary embodiments described above. FIG. 9A shows a cross-sectional side view of a depressor coupled to an aperture in a surface 902 of an explosion-proof enclosure. Specifically, a bearing 910 of the depressor is coupled to the aperture in the surface 902. The depressor shown in FIG. 9A also includes a pushbutton 912 in an undepressed state. The pushbutton 912 is exposed to the outside of the explosion-proof enclosure and is accessible by a user while the explosion-proof enclosure is closed. Coupled to the pushbutton 912 is a shaft 914. Also coupled to the pushbutton 912 is a sealing element 916.

Figure 9B:
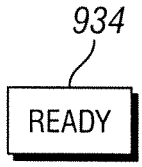

The shaft 914 is coupled to a compressible element 918 between the bottom of the pushbutton 912 and a narrowed area formed by the bearing 910. The shaft 914 is also coupled to a stopper 920 toward the end of the shaft 914. Adjacent to the end of the shaft 914 is a device feature 930 of a device 932. The device feature 930 in this example is a depressible button. The device 932 also includes a device display 934, which can be seen from outside the explosion-proof enclosure through a viewing window 904. FIG. 9B shows that the device display 934 displays "Ready" to designate that the device 932 is awaiting an instruction from a user.

Figure 9C:
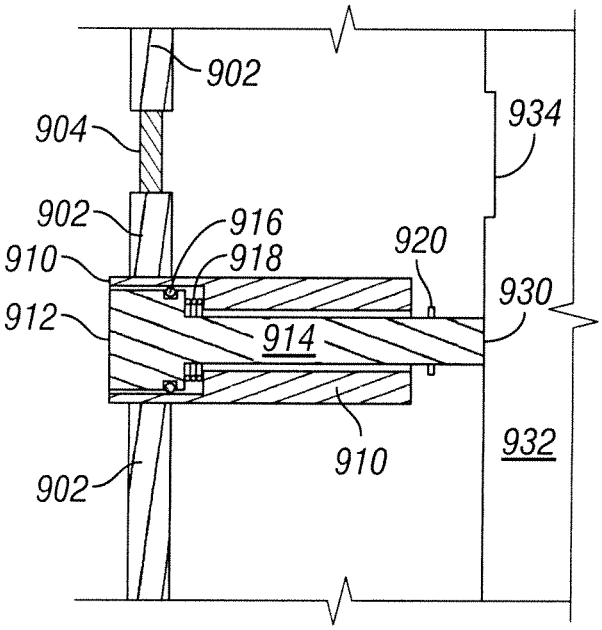
Figure 9D:
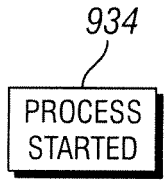

In FIG. 9C, a user moves the pushbutton 912 from an undepressed state to a depressed state (i.e., presses the pushbutton 912). As a result, the shaft 914 moves in the same direction as the pushbutton 912, toward the device 932. Because of the way that the depressor is oriented relative to the device 932, the end of the shaft 914 actuates the device feature 930 (in this example, presses the depressible button on the device 932). When the device feature 930 is actuated, the device 932 executes a corresponding command. In this example, a process is started when the device feature 930 is actuated, as evidenced by the wording in the device display 934 shown in FIG. 9D.

EXAMPLE 2

Figure 10A:
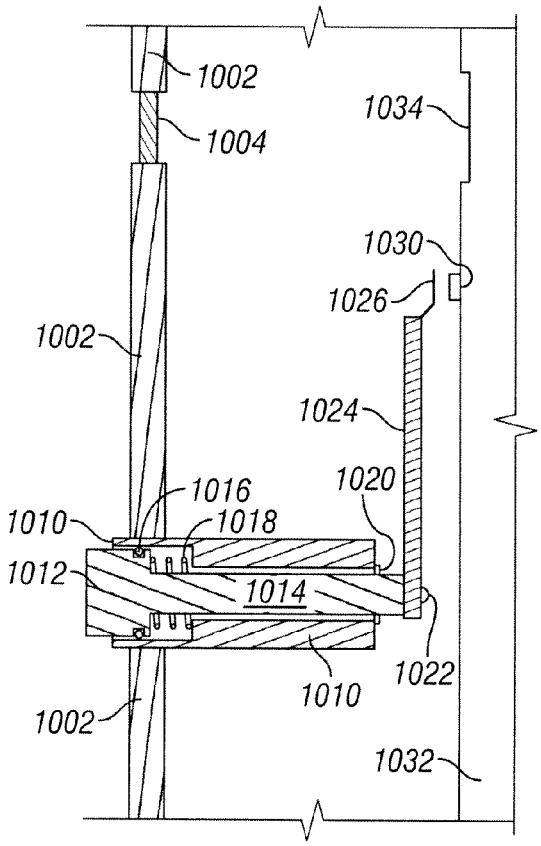
FIGS. 10A and 10B show an example in accordance with one or more exemplary embodiments.
Figure 10B:
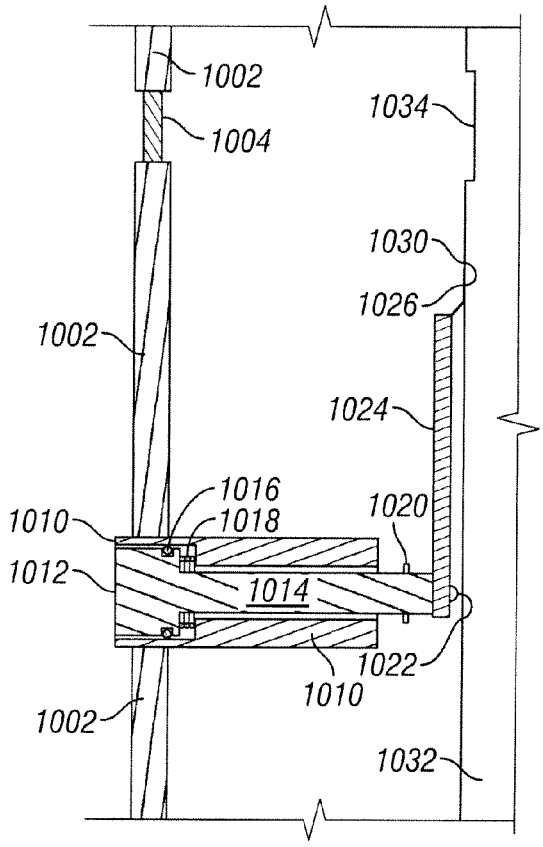

Consider the following example, shown in FIGS. 10A and 10B, which describes actuating at least one feature of a device located inside an explosion-proof enclosure in accordance with one or more exemplary embodiments described above. FIG. 10A shows a cross-sectional side view of a depressor coupled to an aperture in a surface 1002 of an explosion-proof enclosure. Specifically, a bearing 1010 of the depressor is coupled to the aperture in the surface 1002. The depressor shown in FIG. 10A also includes a pushbutton 1012 in an undepressed state. The pushbutton 1012 is exposed to the outside of the explosion-proof enclosure and is accessible by a user while the explosion-proof enclosure is closed. Coupled to the pushbutton 1012 is a depressor shaft 1014. Also coupled to the pushbutton 1012 is a sealing element 1016.

The depressor shaft 1014 is coupled to a compressible element 1018 between the bottom of the pushbutton 1012 and a narrowed area formed by the bearing 1010. The depressor shaft 1014 is also coupled to a stopper 1020 toward the end of the depressor shaft 1014. Coupled to the end of the shaft 1014 is a stem (hidden from view) that traverses an aperture in the cantilever 1024. A fastening device 1022 is used to couple the stem to the cantilever 1024. At the opposite end of the cantilever 1024 is a stepped feature 1026. Adjacent to the stepped feature 1026 of the cantilever 1024 is a device feature 1030 of a device 1032. The device feature 1030 in this example is a depressible button. The device 1032 also includes a device display 1034, which can be seen from outside the explosion-proof enclosure through a viewing window 1004.

In FIG. 10B, a user moves the pushbutton 1012 from an undepressed state to a depressed state (i.e., presses the pushbutton 1012). As a result, the depressor shaft 1014 moves in the same direction as the pushbutton 1012, toward the device 1032. Likewise, the cantilever 1024, particularly the stepped feature 1026, moves toward the device 1032. Because of the way that the depressor (including the cantilever 1024) is oriented relative to the device 1032, the stepped feature 1026 actuates the device feature 1030 (in this example, presses the depressible button on the device 1032). When the device feature 1030 is actuated, the device 1032 executes a corresponding command.

One or more exemplary embodiments provide for actuating at least one feature of a device located inside an explosion-proof enclosure. Specifically, one or more exemplary embodiments are configured to allow a user to depress a depressor outside the explosion-proof enclosure so that a device feature on a device located inside the explosion-proof enclosure may be actuated. By using embodiments described herein, one or more features of the device (and, more specifically, a component (e.g., a VFD) operably coupled to and controlled by the device) located inside the explosion-proof enclosure may be actuated while the explosion-proof enclosure remains closed.

Exemplary embodiments allow for multiple depressors, or a single depressor that is configured to actuate one or more different features for each setting, and its elements (e.g., cantilevers) to be located in close proximity to each other while maintaining operational integrity (e.g., flame paths, functionality of the component (e.g., a VFD) located inside the explosion-proof enclosure). Using one or more exemplary embodiments, components (e.g., a VFD) may be located inside the explosion-proof enclosure and controlled while the explosion-proof enclosure remains closed. Consequently, costs are saved and operating efficiencies are gained by locating such components more proximate to the equipment controlled by such components.

Although actuating at least one feature of a device located inside an explosion-proof enclosure are described with reference to preferred embodiments, it should be appreciated by those skilled in the art that various modifications are well within the scope of actuating at least one feature of a device located inside an explosion-proof enclosure. From the foregoing, it will be appreciated that an embodiment of actuating at least one feature of a device located inside an explosion-proof enclosure overcomes the limitations of the prior art. Those skilled in the art will appreciate that actuating at least one feature of a device located inside an explosion-proof enclosure is not limited to any specifically discussed application and that the exemplary embodiments described herein are illustrative and not restrictive. From the description of the exemplary embodiments, equivalents of the elements shown therein will suggest themselves to those skilled in the art, and ways of constructing other embodiments of actuating at least one feature of a device located inside an explosion-proof enclosure will suggest themselves to practitioners of the art. Therefore, the scope of actuating at least one feature of a device located inside an explosion-proof enclosure is not limited herein.

What is claimed is:

1. A system for actuating at least one feature of multiple features of a device located inside an enclosure, the system comprising:

a depressor extending through a first aperture in a surface of the enclosure; and a cantilever comprising a cantilever shaft having a first cantilever end and a second cantilever end, wherein the depressor comprises a depressor shaft having a first depressor end and a second depressor end, wherein the first depressor end is accessible from outside the enclosure, wherein the depressor is configured to move between an undepressed state and a depressed state, wherein the second depressor end contacts the at least one feature of the multiple features of the device when the depressor is in the depressed state, wherein the first cantilever end comprises a stepped feature extending therefrom, wherein the second cantilever end is orthogonally coupled to the depressor shaft, and wherein the stepped feature contacts the at least one feature of the multiple features of the device when the depressor is in the depressed state.

2. The system of claim 1, wherein the second depressor end is coupled to the second cantilever end using a stem affixed to the second depressor end, wherein the stem traverses a second aperture in the second cantilever end.

3. The system of claim 2, wherein the depressor further comprises a bearing, wherein the bearing comprises:

a dial rotatably extending through the first aperture in the surface, wherein the dial comprises a face with a plurality of positions located adjacent to the surface outside the enclosure, wherein the plurality of positions corresponds to the multiple features; and a housing rotatably coupled to the dial and located inside the enclosure, wherein the housing comprises a first portion, a second portion, and the plurality of positions, wherein the first portion comprises a cavity for receiving the pushbutton, wherein the second portion comprises a template, and wherein each position of the plurality of positions aligns the template with at least one secondary depressor, wherein the at least one secondary depressor is orthogonally coupled to the second cantilever end.

4. The system of claim 1, wherein each cantilever of the plurality of cantilevers comprises substantially similar dimensions.

5. The system of claim 1, wherein the depressor comprises a keypad.

6. The system of claim 1, wherein the enclosure is an explosion-proof enclosure that meets National Electrical Manufactures Association standards, and wherein the depressor creates a first flame path where the depressor is coupled to the first aperture.

7. The system of claim 1, wherein the enclosure is a hose-tight enclosure that meets standards as a National Electrical Manufactures Association 4 enclosure.

8. A system for actuating multiple features of a device located inside an enclosure, the system comprising:

a surface of the enclosure, wherein the surface comprises a first aperture comprising first dimensions;

a plate slideably coupled to an underside of the surface, wherein the plate comprises second dimensions larger than the first dimensions of the first aperture, wherein the plate further comprises a second aperture, and wherein the plate is configured to move among a plurality of positions that correspond to the multiple features; and a depressor traversing through the second aperture, wherein the depressor comprises:

a bearing fixedly coupled to the second aperture of the plate;

a pushbutton located outside the enclosure and positioned inside the bearing, wherein the pushbutton moves between an undepressed state and a depressed state; and a depressor shaft comprising a first depressor end and a second depressor end, wherein the pushbutton is coupled to the first depressor end, and wherein the second depressor end is used to actuate the at least one feature of the multiple features of the device when the pushbutton is in the depressed state.

9. The system of claim 8, wherein the second depressor end comprises a plurality of cantilevers positioned inside the enclosure, wherein each cantilever of the plurality of cantilevers comprises a cantilever shaft having a first cantilever end and a second cantilever end, wherein the first cantilever end comprises a stepped feature extending therefrom, wherein the first cantilever end is configured to contact the at least one feature of the multiple features of the device when the pushbutton is in the depressed state, wherein the depressor shaft contacts the second cantilever end when the pushbutton is in the depressed state, and wherein each cantilever corresponds to at least one position of the plurality of positions of the plate.

10. The system of claim 8, further comprising:

a compressible element coupled to the bearing, wherein when the pushbutton is in the undepressed state, the compressible element is in a normal state, and when the pushbutton is in the depressed state, the compressible element is in a compressed state.

11. The system of claim 10, wherein the compressible element is at least one selected from a group consisting of a spring and compressible rubber.

12. The system of claim 8, wherein the plate is locked into a position of the plurality of positions by at least one detent.

13. The system of claim 8, wherein the enclosure is an explosion-proof enclosure that meets National Electrical Manufactures Association standards, and wherein the plate covers the first aperture and overlaps with the underside of the surface to form a flame path.

14. The system of claim 8, wherein the enclosure is a hose-tight enclosure that meets standards as a National Electrical Manufactures Association 4 enclosure.

15. The system of claim 8, further comprising:

a viewing window mounted within a third aperture in the surface of the enclosure, wherein the second aperture is located adjacent to the pushbutton.

16. The system of claim 15, wherein the device comprises a device display that can be seen through the viewing window, wherein the device display indicates a status of the device located inside the enclosure.

17. The system of claim 9, further comprising:

a bracket mechanically coupled to the surface inside the enclosure, wherein the bracket comprises a plurality of holes through which the plurality of cantilevers traverse.

18. The system of claim 17, wherein each of the plurality of holes is defined by at least one cantilever guide of the bracket.

19. The system of claim 18, wherein the at least one cantilever guide controls a travel distance of at least one of the plurality of cantilevers.

20. A system for actuating at least one feature of multiple features of a device located inside an enclosure, the system comprising:

a depressor extending through a first aperture in a surface of the enclosure, wherein the depressor comprises a depressor shaft having a first depressor end and a second depressor end, wherein the first depressor end is accessible from outside the enclosure, wherein the depressor is configured to move between an undepressed state and a depressed state, wherein the second depressor end contacts the at least one feature of the multiple features of the device when the depressor is in the depressed state, wherein the first depressor end comprises a pushbutton, wherein the depressor further comprises a bearing, wherein the pushbutton extends through the bearing and is moveable between the undepressed state and the depressed state, wherein the bearing is fixedly coupled to the surface, wherein the bearing comprises:

a dial rotatably extending through the first aperture in the surface, wherein the dial comprises a face with a plurality of positions located adjacent to the surface outside the enclosure, wherein the plurality of positions corresponds to the multiple features; and a housing rotatably coupled to the dial and located inside the enclosure, wherein the housing comprises a first portion, a second portion, and the plurality of positions, wherein the first portion comprises a cavity for receiving the pushbutton, wherein the second portion comprises a template, and wherein each position of the plurality of positions aligns the template with the second depressor end of at least two second depressor ends.

21. The system of claim 20, further comprising:

a compressible element coupled to the pushbutton, wherein the compressible element is in a normal state when the pushbutton is in the undepressed state, and wherein the compressible element is in a compressed state when the pushbutton is in the depressed state.

22. The system of claim 21, wherein the compressible element is at least one selected from a group consisting of a spring and compressible rubber.

23. The system of claim 21, wherein the compressible element is located inside the bearing and around a portion of the depressor shaft.

* * * * *